US010806318B2

(12) United States Patent
Erkek et al.

(10) Patent No.: US 10,806,318 B2
(45) Date of Patent: Oct. 20, 2020

(54) SYSTEM WITH AT LEAST TWO CLEANING DEVICES

(71) Applicant: Vorwerk & Co. Interholding GmbH, Wuppertal (DE)

(72) Inventors: David Erkek, Aarau (CH); Georg Hackert, Bochum (DE); Gerhard Isenberg, Cologne (DE); Roman Ortmann, Huerth (DE); Andreas Schmidt, Mettmann (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 335 days.

(21) Appl. No.: 16/009,421

(22) Filed: Jun. 15, 2018

(65) Prior Publication Data

US 2018/0360282 A1 Dec. 20, 2018

(30) Foreign Application Priority Data

Jun. 16, 2017 (DE) ..... 10 2017 113 285

(51) Int. Cl.

*A47L 9/28* (2006.01)
*A47L 9/19* (2006.01)
*B08B 5/04* (2006.01)

(52) U.S. Cl.

CPC ..... *A47L 9/2852* (2013.01); *A47L 9/19* (2013.01); *A47L 9/28* (2013.01); *A47L 9/2847* (2013.01); *A47L 9/2857* (2013.01); *A47L 9/2894* (2013.01); *B08B 5/04* (2013.01); *A47L 2201/024* (2013.01); *A47L 2201/04* (2013.01); *A47L 2201/06* (2013.01)

(58) Field of Classification Search

CPC ..... A47L 9/2852; A47L 9/2894; A47L 9/19; A47L 9/2857; A47L 2201/04; B08B 5/04
See application file for complete search history.

(56) References Cited

U.S. PATENT DOCUMENTS

| | | | | |
|---|---|---|---|---|
| 8,742,926 | B2 * | 6/2014 | Schnittman | A47L 9/2894 340/540 |
| 9,298,183 | B2 * | 3/2016 | Artes | G05D 1/0219 |
| 9,392,920 | B2 * | 7/2016 | Halloran | A47L 9/2857 |
| 2015/0170509 | A1 * | 6/2015 | Artes | G08B 13/18 340/501 |
| 2016/0166126 | A1 * | 6/2016 | Morin | A47L 7/0004 15/319 |
| 2017/0112345 | A1 * | 4/2017 | Frey | A47L 9/2852 |

FOREIGN PATENT DOCUMENTS

DE 10 2012 109 938 A1 4/2014

* cited by examiner

*Primary Examiner* — Ramsey Refai
(74) *Attorney, Agent, or Firm* — Collard & Roe, P.C.

(57) ABSTRACT

A system has at least two cleaning devices, wherein at least one of the cleaning devices can be displaced relative to another cleaning device. In order to perform a service on one of the cleaning devices in an especially advantageous manner, the cleaning devices each have a communications link to a shared controller, wherein the controller is set up to transmit a service request to the second cleaning device and/or to a user of the second cleaning device, depending on the service required by a device component of a first cleaning device, and depending on the service availability status of a second cleaning device.

10 Claims, 5 Drawing Sheets

SYSTEM WITH AT LEAST TWO CLEANING DEVICES

CROSS REFERENCE TO RELATED APPLICATIONS

Applicant claims priority under 35 U.S.C. § 119 of German Application No. 10 2017 113 285.6 filed Jun. 16, 2017, the disclosure of which is incorporated by reference.

BACKGROUND OF THE INVENTION

1. Field of the Invention

The invention relates to a system with at least two cleaning devices, wherein at least one of the cleaning devices can be displaced relative to another cleaning device.

The invention further relates to a method for operating a system with at least two cleaning devices, wherein at least one of the cleaning devices is displaced relative to another cleaning device.

2. Description of the Related Art

Cleaning devices are sufficiently known in prior art in a plurality of various embodiments. For example, the cleaning devices can be conventional household cleaning devices like vacuum cleaners, wiping devices, vacuum-wiping combinations and the like. In addition, cleaning devices are here also to be understood as devices that perform a floor processing job, such as polishing or grinding, or can mow a lawn outside of a household. The cleaning devices can be guided manually by a user, for example in such a way during operation that a user pushes them in front of him or herself or guides them back and forth over a surface. Further known are automatically moving cleaning devices, which in particular can be designed as cleaning robots such as vacuuming robots and/or wiping robots.

Further known in prior art is that cleaning devices display a required service for one of their device components. For example, DE 10 2012 109 938 A1 discloses an automatically movable floor dust collection device with a dust collector and a display means, which generates an optical and/or acoustic message that the dust collector must be emptied. In order to empty the dust collector, the latter is connected with a suction apparatus of another cleaning device, for example a vacuum cleaner or a base station.

The disadvantage here is that the user must keep a base station readily available or take another vacuum cleaner from a storage place and make it ready for operation at the moment the cleaning device requires the service.

SUMMARY OF THE INVENTION

Proceeding from the prior art described above, the object of the invention is to further develop a system with at least two cleaning devices in such a way that a second cleaning device can be used to perform a service on one of the cleaning devices in an especially comfortable manner.

In order to achieve the aforementioned object, the invention proposes a system with at least two cleaning devices, wherein at least one of the cleaning devices can be displaced relative to another cleaning device, wherein the cleaning devices each have a communications link to a shared controller, wherein the controller is set up to transmit a service request to the second cleaning device and/or to a user of the second cleaning device, depending on the service required by a device component of a first cleaning device, and on the service availability status of a second cleaning device.

According to the invention, the two or more cleaning devices of the system are now connected with each other within a communication network in such a way that each of the cleaning devices is connected with the shared controller of the communication network, so that the controller can communicate with each of the cleaning devices, and receive information about a service availability and/or information about a required service of a cleaning device via the respective communications link. The shared controller thus serves as a control center, which is set up to receive a service request and/or operating status of a cleaning device and further process it so that the cleaning devices of the system can advantageously interact with each other. The communications link between a cleaning device and the shared controller can preferably be wireless in design, in particular have data communication via WLAN, Bluetooth, ZigBee or the like. In addition, however, wired communication technologies are basically also possible, e.g., PowerLAN. If a cleaning device of the system needs to be serviced by another cleaning device of the system, it transmits information about its required service to the shared controller, which thereupon transmits a message about the required service to one or several cleaning devices of the system, which are suitable for satisfying the required service. To this end, the shared controller checks the service availability of one or several cleaning devices present in the system, so that a request for service is only transmitted to a cleaning device that is currently available for service at the time. Service availability is to be understood as a state of the cleaning device in which it is turned on, i.e., ready for operation, and has enough capacity for the service to be performed. In the event the service involves emptying a suction material collector, the service availability entails a sufficient receiving capacity of a suction material collector of the cleaning device and/or a sufficient battery charging capacity to automatically move the cleaning device providing the service to a location of the cleaning device to be cleaned or the like. The request for performing a service can here either be automatically transmitted directly to the second cleaning device and/or to a user of the second cleaning device. In the latter case, for example, the request can be shown on a display of the second cleaning device, so that a user currently using the second cleaning device is informed that a first cleaning device requires a service, for example. Since the second cleaning device intended to perform the service has already been made operational by the user, only a slight effort is required to briefly use this cleaning device to perform the service on the first cleaning device.

The cleaning devices of the system are registered to the shared controller, so that the controller knows which cleaning devices in the system are available. The cleaning devices can be registered directly to the shared controller, or also to or via a cleaning device of the system. Registration can take place manually or automatically by registering each cleaning device to another cleaning device provided for registration or to the shared controller. To this end, it is possible that the cleaning device to be registered have an optical code, for example, which is arranged on its housing surface, in particular a barcode, QR code or the like. Registration can also involve communication between two participating cleaning devices and/or between the cleaning device to be registered and the shared controller by means of a wireless radio communication means, such as WLAN, NFC, Bluetooth, ZigBee or the like. The transmitted device code allows the controller to recognize how to address the respective cleaning device or how to detect a service availability status of the respective cleaning device. Among other things, for example, the device code can contain information about whether data are transmitted acoustically, optically, via radio communication or in other ways. During acoustic data transmission, for example, the device code could contain information about an identifiable sound allocated to the respective cleaning device. In an optical process, information can be present in the form of image information, for example, wherein a defined movement by a cleaning device signals a required service or service availability, for example. Correspondingly to the cleaning devices of the system, the shared controller must then also be designed so that it is set up to receive and evaluate corresponding information from the cleaning devices. After the shared controller has received information about a required service of a first cleaning device, it informs either a cleaning device available for a service and/or a user of a respective cleaning device about the required service. The request to perform a service contained therein can be output, for example, by having the cleaning device in need of service or the cleaning device available for service transmit an acoustic and/or optical signal to the user. For example, the cleaning device can have a display, an LED, a loudspeaker, a vibration element or the like. In addition, the shared controller can also have an acoustic and/or optical display means, with which the user can be informed.

It is proposed that the controller be set up to transmit a control command for performing the service to the second cleaning device. In this embodiment, the shared controller prompts a cleaning device to directly perform the service without requiring the user of the cleaning device to do anything. As a consequence, this embodiment allows the second cleaning device to fully automatically provide a service for the first cleaning device. The shared controller can here simultaneously transmit information about a current device location of the first cleaning device with the control command, so that the second cleaning device can move toward the first cleaning device, for example. In this fully automatic control of the service for the second cleaning device, it may be advisable that the second cleaning device transmit information about service implementation to a user, so that he or she is informed about the operation of the first and/or second cleaning device, and thus is not startled, does not stumble over one of the cleaning devices, or the like.

In addition, it is proposed that the controller be a local controller of the first or second cleaning device or a central controller of the system formed outside of the cleaning devices, in particular a controller of a home automation system. In a first embodiment, the shared controller can thus be a controller that is integrated into one of the cleaning devices. As a consequence, this cleaning device simultaneously also comprises the shared controller of the system, which receives service queries of the cleaning devices of the system and generates and outputs control commands and/or service requests. In an alternative embodiment, the controller of the system can be a separate controller, which is not built into any of the cleaning devices. The shared controller is here always available even when the cleaning devices are turned off. In particular, the shared controller can be a controller of a home automation system. For example, the home automation system can have a WLAN network, in which the cleaning devices and controller communicate with each other via WLAN communication modules. In this system, the controller forms an access point, for example, which handles communication between the cleaning devices. Apart from the system with at least two cleaning devices, the home automation system can further have other components which are not cleaning devices, e.g., a heater, an air conditioner, an illuminating device, a shutter system, a closing device and the like.

In addition, it is proposed that the device component requiring service be a suction material collector of a first cleaning device designed as a vacuum cleaner. It can further be provided that the second cleaning device be a vacuum cleaner manually guideable by a user. In this embodiment, it is proposed that the system according to the invention be a communication system between several vacuum cleaners, for example, wherein at least one of the cleaning devices is designed for regenerating a suction material collector of the other cleaning device. The first cleaning device can here be either a stationary or automatically moving vacuum cleaner. A vacuum cleaner is can here be construed to involve all such devices that have a suction-fan unit. These include conventional household vacuum cleaners, but also base stations for cleaning devices, for example, which themselves can regenerate a suction material collector of another device, for example, i.e., take suction material from one cleaning device into their own suction material collector, for example. The second cleaning device is designed to perform the service, and can preferably be a vacuum cleaner manually guideable by a user, for example a conventional upright vacuum cleaner, which the user manually guides over a surface to be cleaned during a cleaning operation. In the event that the second cleaning device is a cleaning device to be guided by the user, and not an automatically moving cleaning device, it is recommended that the user of the second cleaning device be prompted by the controller to move, for example carry or pull, the manually guided cleaning device to the first cleaning device, or to bring the first cleaning device to the second cleaning device. Alternatively, an autonomous first cleaning device can also be steered fully automatically to the location of the second cleaning device.

It is proposed that the controller be set up to generate a control command for moving the second cleaning device to a device location of the first cleaning device and transmit it to the second cleaning device. Alternatively or also additionally, it can be provided that the controller be set up to generate a control command for moving the first cleaning device to a device location of the second cleaning device and transmit it to the first cleaning device. The controller is thus designed to control a movement of the first and/or second cleaning device in such a way that the two cleaning devices are moved toward each other for the service. The controller is designed to evaluate the known information about the cleaning devices registered in the system in such a way that a respective control command for movement only be transmitted to such a cleaning device that is actually also suitable for automatic movement.

Further proposed in addition to the system described above with at least two cleaning devices and a shared controller is a method for operating a system with at least two cleaning devices, wherein at least one of the cleaning devices is displaced relative to another cleaning device, wherein the cleaning devices each communicate with a shared controller via a communications link, wherein the controller transmits a request for performing a service to the second cleaning device and/or to a user of the second cleaning device, depending on a required service for a device component of a first cleaning device and depending on the service availability status of a second cleaning device. In the method according to the invention, one of the cleaning devices networked in the system transmits a required service for one of its device components to the shared controller of the system, whereupon the controller checks a service availability status for a second cleaning device, which would be suitable for performing a corresponding service, and in the event that the second cleaning device is available and suitable to this end, for transmitting a request to perform the corresponding service to the second cleaning device and/or to a user of the second cleaning device, so that either the second cleaning device can perform the service fully automatically, or the user guides and/or controls the second cleaning device in such a way that it can perform the service on the first cleaning device. Otherwise, the statements made in relation to the system according to the invention also apply accordingly to the method according to the invention.

In particular, it can be provided that the request for performing a service be transmitted acoustically, optically and/or haptically to the user by a display means of the first or second cleaning device. The user can thus be informed directly by the first cleaning device that requires service, or by the second cleaning device that he or she is currently operating. It can be provided that the user be performing a cleaning operation with the second cleaning device at that point, during which the request to perform a service reaches him or her. In particular, for example, a warning lamp of the first or second cleaning device can light up, a loudspeaker can emit a corresponding signal, or, given the second cleaning device currently being held by the user, a vibration element can also vibrate, providing the user with haptic information about the required service. The request makes the user aware of the required service, and he or she can accordingly perform a service by means of the second cleaning device. In particular, the user along with the second cleaning device can move to the first cleaning device, and there perform a service. Alternatively, it is also conceivable that the user bring the first cleaning device to the device location of the second cleaning device. If necessary, an indicating means, e.g., a display, can also transmit information about the current device location of the first cleaning device, letting the user know where the first cleaning device is currently located.

In addition, it is proposed that the controller control the second cleaning device for performing a service on the device component of the first cleaning device. In this procedure, the second cleaning device automatically performs a service on the first cleaning device. It is not required that a user of the system act on the second cleaning device so as to thereby perform the service. Rather, the controller sends a control command directly to the second cleaning device, whereupon the latter is prompted to perform a corresponding activity.

In particular, it is proposed that the controller generate a control command for moving the second cleaning device to a device location of the first cleaning device, and transmit it to the second cleaning device. Alternatively, it can be provided that the controller generate a control command for moving the first cleaning device to a device location of the second cleaning device, and transmit it to the first cleaning device. In the first mentioned procedure, the second cleaning device intended to perform the service is called to the device location of the first cleaning device. By contrast, the first cleaning device requiring the service can remain at its device location, and there wait for the second cleaning device to arrive. For example, this procedure is recommended when the first cleaning device is not an automatically movable cleaning device. In the second mentioned procedure, the controller steers the first cleaning device to the device location of the second cleaning device, which is providing the service. In this case, the first cleaning device is an automatically movable cleaning device, for example a cleaning robot. The latter is steered to the device location of the second cleaning device, which provides the service.

Finally, the invention proposes that a fill level of a suction material collector of the first cleaning device be detected, wherein a required service for the suction material collector is transmitted to the controller, wherein the controller determines a service availability status for the second cleaning device, and controls at least one of the cleaning devices in such a way that it moves toward the other cleaning device, and the suction material collector of the first cleaning device is emptied by a mechanism of the second cleaning device. In this embodiment, the service for the first cleaning device involves a need to empty the suction material collector, for example since it has reached a maximum fill level. The first cleaning device here has a conventional detection system for detecting a fill level of the suction material collector. If a defined limit for the fill level has been exceeded, the first cleaning device transmits its required service to the shared controller of the system, whereupon the controller checks whether one or more cleaning devices of the system are suitable and ready for the service. To this end, the service availability status is preferably checked for each cleaning device of the system, wherein routine status messages of the cleaning devices networked in the system are evaluated, for example. If several cleaning devices are available for performing the service, i.e., turned on and/or currently in use, the shared controller can further determine which cleaning device has the shortest path to the device location of the first cleaning device and/or which one would not have to interrupt any cleaning job currently being done to perform the service on the first cleaning device. As soon as the optimal cleaning device for the service has been determined, either the first cleaning device that requires the service can move to the second cleaning device, or vice versa. The shared controller can determine which cleaning device is moved by the shared controller to the respective other cleaning device not least based on the device type of the cleaning devices. If only one of the cleaning devices is a mobile cleaning device, the mobile cleaning device is preferably steered toward the stationary cleaning device. Mobile cleaning devices are here either cleaning robots, which can automatically move within the environment, or also cleaning devices that can be displaced by a user. One example would be upright vacuum cleaners, which a user drags behind him or herself.

BRIEF DESCRIPTION OF THE DRAWINGS

The invention will be described in more detail below based on exemplary embodiments. Shown on:

FIG. 3 is the system depicted on FIG. 2 during a request for performing a service to a user of the second cleaning device.

DETAILED DESCRIPTION OF THE PREFERRED EMBODIMENTS

Figure 1:
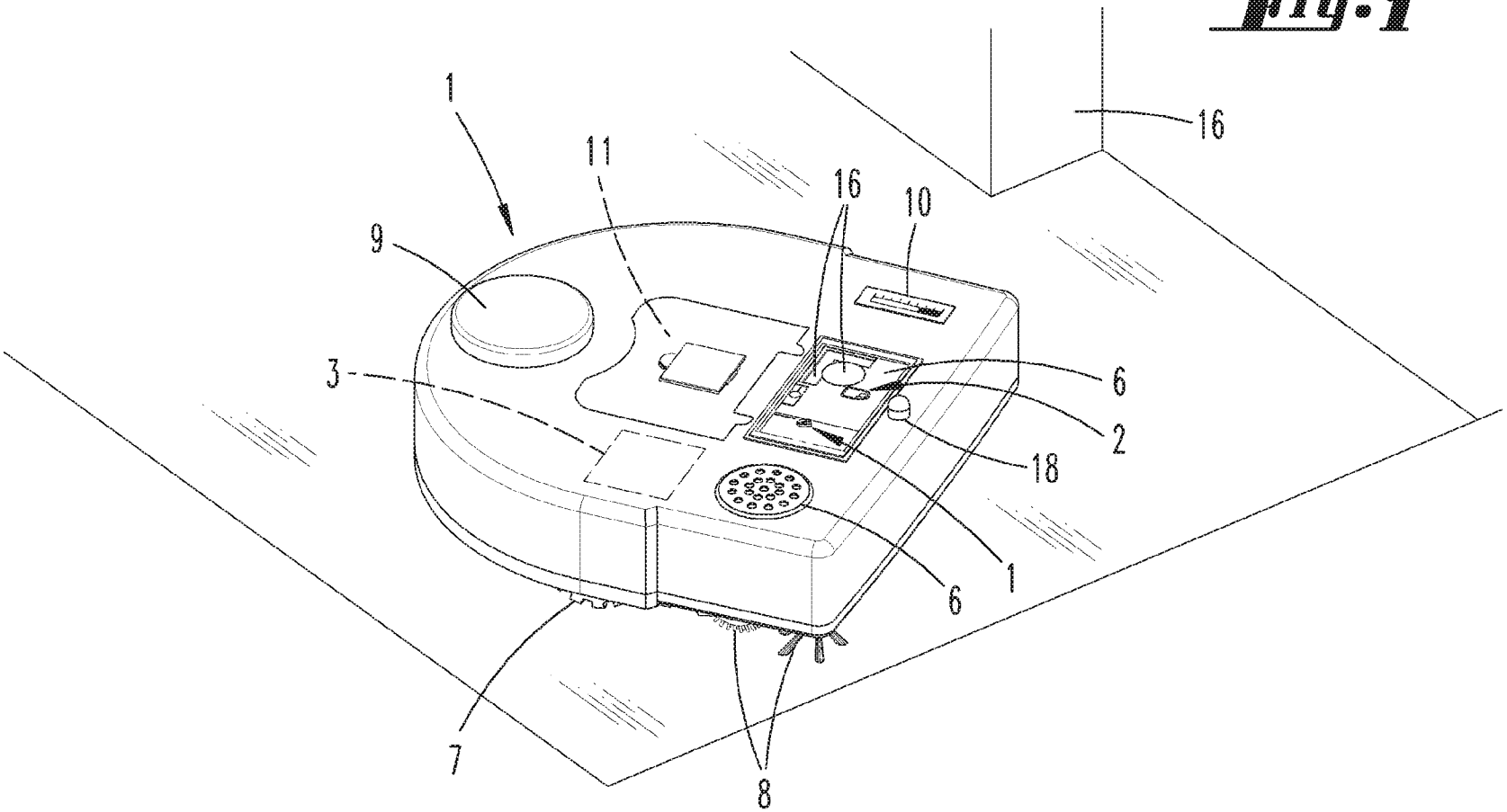
FIG. 1 is an automatically moving cleaning device.

FIG. 1 shows a cleaning device 1, which here is designed as a vacuuming robot. The cleaning device 1 has motordriven wheels 7, which it can use to move around within an environment. In addition, the cleaning device 1 has cleaning elements 8, specifically a side brush, which protrudes over a device housing of the cleaning device 1, along with a bristle roller, which rotates around an essentially horizontal axis, and in so doing acts on a surface to be cleaned. In the area of the cleaning elements 8, the cleaning device 1 further has a suction nozzle opening, through which air loaded with suction material can be sucked into the cleaning device 1 by means of a motor-fan unit. The cleaning device 1 has a rechargeable battery (not shown) to supply power to the electrical components of the cleaning device 1, in particular to drive the wheels 7 and cleaning elements 8 and any other electronics provided. In addition, the cleaning device 1 is equipped with a detection system 9, which here has a triangulation measuring system, for example. The detection system 9 measures distances to obstacles 16 (e.g., see FIG. 2) within the environment of the cleaning device 1. The detection system 9 specifically has a laser diode, whose emitted light beam is guided out of a housing of the cleaning device 1 by a diverter, and can rotate around a rotational axis that is perpendicular in the depicted orientation of the cleaning device 1, in particular at a measuring angle of 360 degrees. This enables a distance measurement around the entire cleaning device 1. The detection system 9 can be used to measure the environment of the cleaning device 1 in a preferably horizontal plane, i.e., in a plane parallel to the surface to be cleaned. As a result, the cleaning device 1 can travel in the environment without colliding with obstacles 16, in particular furniture and walls. The measurement data recorded by the detection system 9, which here represent distances to obstacles 16 in the environment, are used to generate an area map. The area map is used by a controller 3 of the cleaning device 1 to navigate and self-localize within the environment. The area map is here further shown on a display means 6 of the cleaning device 1, specifically on a display of the cleaning device 1. This provides a user of the cleaning device 1 with knowledge about the environment as viewed by the cleaning device 1, specifically about the obstacles 16, the position of the cleaning device 1 itself in the environment, and any additional cleaning devices 2 that might be present within the environment. For example, the cleaning device 1 can further have an odometer (not shown), which measures the distance covered by the cleaning device 1 based on a rotation of the wheels 7. In addition, it is also possible for the cleaning device 1 to have contact sensors or the like, for example.

The cleaning device 1 further has a local memory (not shown), which is allocated to the controller 3 of the cleaning device 1. The local memory is used to store the area map, or at least a portion of the area map. The controller 3 of the cleaning device 1 accesses this memory to perform navigation and self-localization calculations.

The cleaning device 1 has a suction material collector 11 for collecting suction material, which was picked up from the surface to be cleaned by the motor-fan unit of the cleaning device 1. The suction material collector 11 has allocated to it a fill level indicator 10, which indicates a current fill level of the suction material collector 11. A measuring system (not shown in any more detail) is allocated to the suction material collector 11 for measuring the fill level. This can measure a fill level of the suction material collector 11 or perform a differential pressure measurement or the like. The controller 3 of the cleaning device 1 is further designed to determine a required service for a device component, e.g., the suction material collector 11, and use a display means 6 to output a request for performing a service, e.g., here specifically emptying the suction material collector 11. For example, the display means 6 can here be the display of a cleaning device 1, which in particular can display a written message to a user 5 of the cleaning device 1, or a loudspeaker designed as a display means 6 for outputting an acoustic signal. In addition, the cleaning device 1 has a communications module 18, which can be used to radio a required service from the controller 3 to a user 5 or another cleaning device 2. For example, the communications module 18 is here a WLAN module, which can communicate with another WLAN module. In particular, the communications module 18 of the cleaning device 1 is used to transmit a request for emptying the suction material collector 11 to a user 5 or another cleaning device 2.

Figure 2:
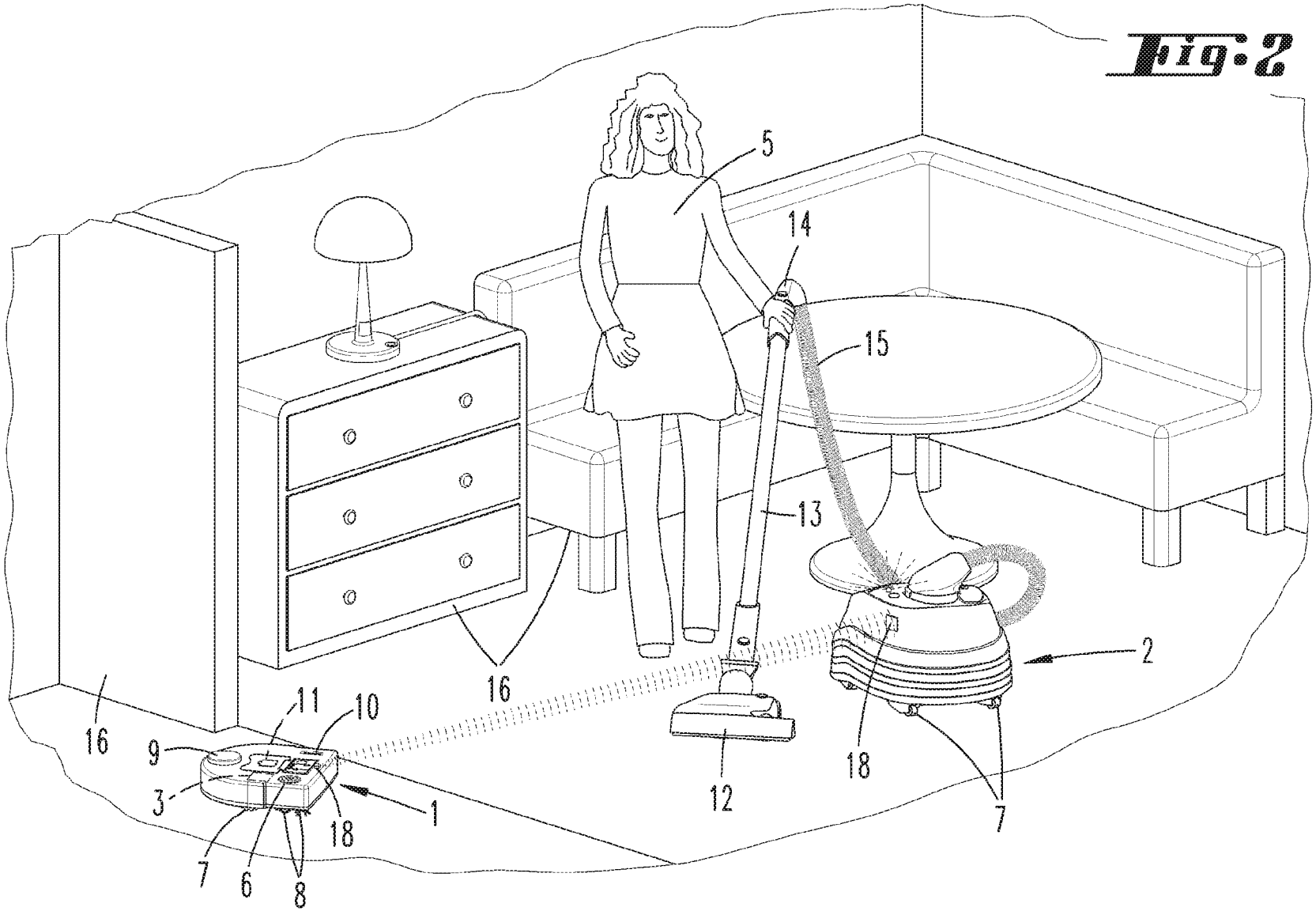
FIG. 2 is a system comprised of a first cleaning device and a second cleaning device.

FIG. 2 shows a room situation in which the cleaning device 1 interacts with another cleaning device 2 within a system. The second cleaning device 2 is here a cleaning device that can be hand guided by a user 5, specifically an upright vacuum cleaner, which the user 5 drags behind him or herself during a cleaning operation. The cleaning device 2 has wheels 7, which make it easy to displace the cleaning device 2 on a surface to be cleaned. In addition, the cleaning device 2 is equipped with a conventional floor nozzle 12 hand guided by the user 5, which is connected with the cleaning device 2 by a stalk 13 and hose 15. Also arranged on the stalk 13 is a handle 14, whose purpose is to be gripped by the user 5. In the area of the handle 14, the stalk 13 along with the floor nozzle 12 can be separated from the cleaning device 2, so that the handle 14 ends in a suction nozzle 17 (see FIG. 4) with a smaller opening cross section. For example, this suction nozzle 17 is used to perform cleaning jobs in hollow spaces, cramped partial areas of the environment or the like. In addition, the cleaning device 2 also has a communications module 18, here specifically a WLAN communications module as well, which the second cleaning device 2 can use to communicate with the first cleaning device 1 of the system.

In the situation shown on FIG. 2, the user 5 performs a cleaning job with the second cleaning device 2. The user here pushes the floor nozzle 12 in front of him or herself, and moves it back and forth over the surface to be cleaned. The first cleaning device 1 is here in an adjacent room or partial area of a room in a home of the user 5, for example. In the depicted situation, the first cleaning device 1 can itself perform a cleaning job, wherein the first cleaning device 1 automatically travels within the room. However, in the depicted situation, the first cleaning device 1 can alternatively also be idling, yet operational in the room.

The method will here initially be described based on an idling, operational first cleaning device 1. The first cleaning device 1 had previously performed a cleaning activity, for example, and in the process picked up suction material in its suction material collector 11. So much suction material was picked up in the process that the quantity of collected suction material exceeded a defined limit. The controller 3 of the first cleaning device 1, which here is the shared controller 3 of the system comprised of the two cleaning devices 1, 2, checks whether other cleaning devices 2 are currently active within the system, and available for emptying the suction material collector 11 of the first cleaning device 1. To this end, the shared controller 3, which is here the local controller 3 of the first cleaning device 1, has information about the other cleaning devices 2 of the system, here specifically about the second cleaning device 2. For example, the information about the second cleaning device 2 known to the controller 3 consists of a device identification of the second cleaning device 2, a communications protocol to be used for communication between the corresponding communications modules 18, as well as information about a current service availability status of the second cleaning device 2, which the second cleaning device 2 had previously transmitted to the first cleaning device 1. The service availability status can be transmitted either continuously, in specific intervals or even just when a change in status arises.

At the moment the required service for emptying the suction material collector 11 of the first cleaning device 1 arises, if the controller 3 determines that the second cleaning device 2 is currently not active, i.e., is here turned off, for example, the first cleaning device 1 waits until a change in service availability status has been noted indicating that the user 5 is making the second cleaning device 2 operational. To this end, for example, the cleaning device 1 idles in a partial area of the room while the controller 3 monitors the status messages sent out by the second cleaning device 2. If additional cleaning devices 2 other than the second cleaning device 2 are located in the system, status messages from these additional cleaning devices 2 can correspondingly also be monitored. As soon as the user 5 has put the second cleaning device 2 in operation, the second cleaning device 2 transmits its "active" status to the controller 3, or here the first cleaning device 1. The status message is transmitted between the two communications modules 18. The situation is depicted on FIG. 2. The shared controller 3 of the system, i.e., the local controller 3 of the first cleaning device 1, processes the status of the second cleaning device 2, and transmits a request to perform a service to the user 5 of the second cleaning device 2. This situation is depicted on FIG. 3. For example, the request here involves an acoustic message "please empty", which is output by the display means 6, here specifically the loudspeaker, of the first cleaning device 1. The user 5 is made aware of the first cleaning device 1 by the acoustic request, and manually guides the second cleaning device 2 to the device location of the first cleaning device 1.

Figure 4:
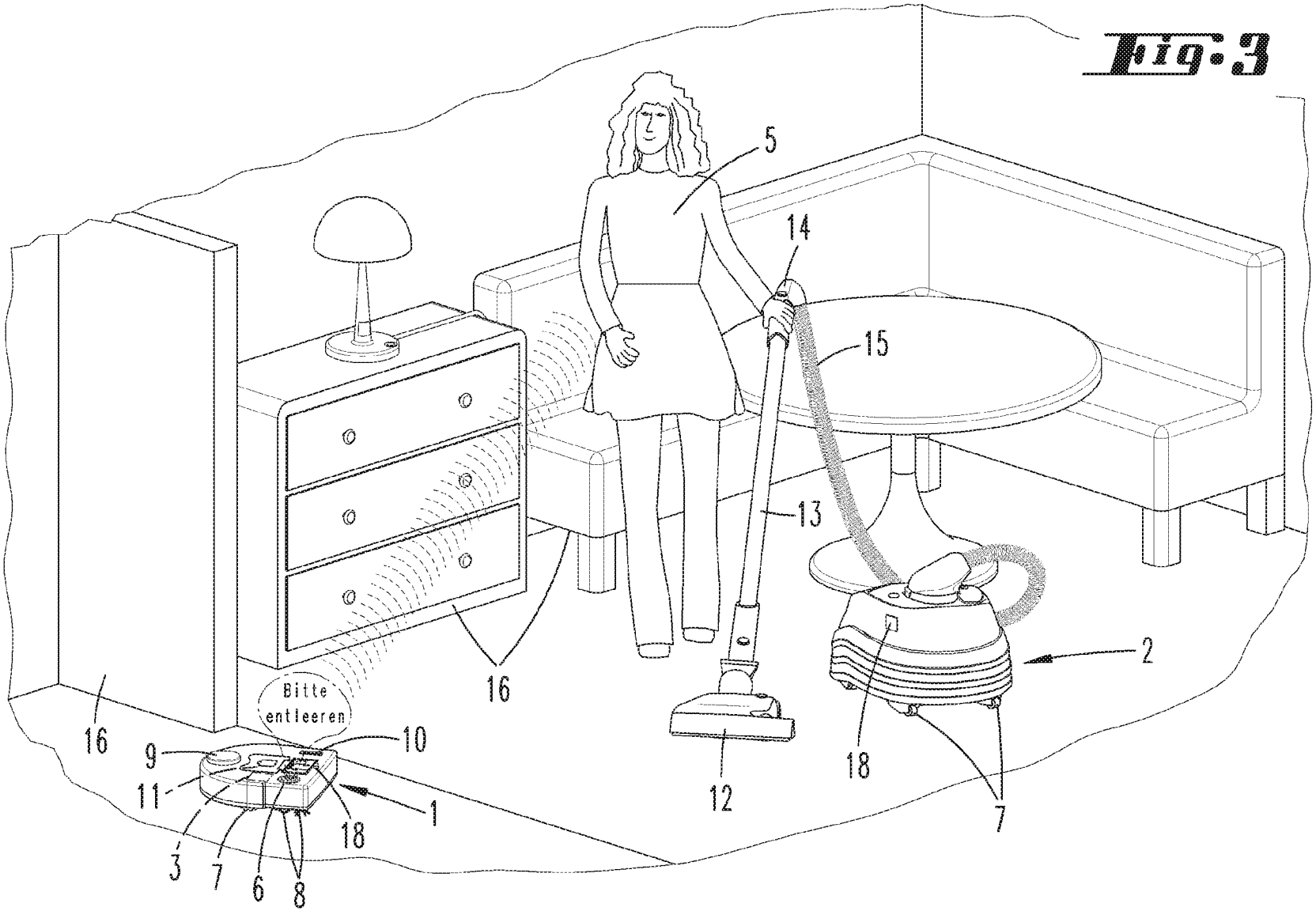
FIG. 4 is the system according to FIGS. 2 and 3 while the second cleaning device performs a service on the first cleaning device.
Figure 4:
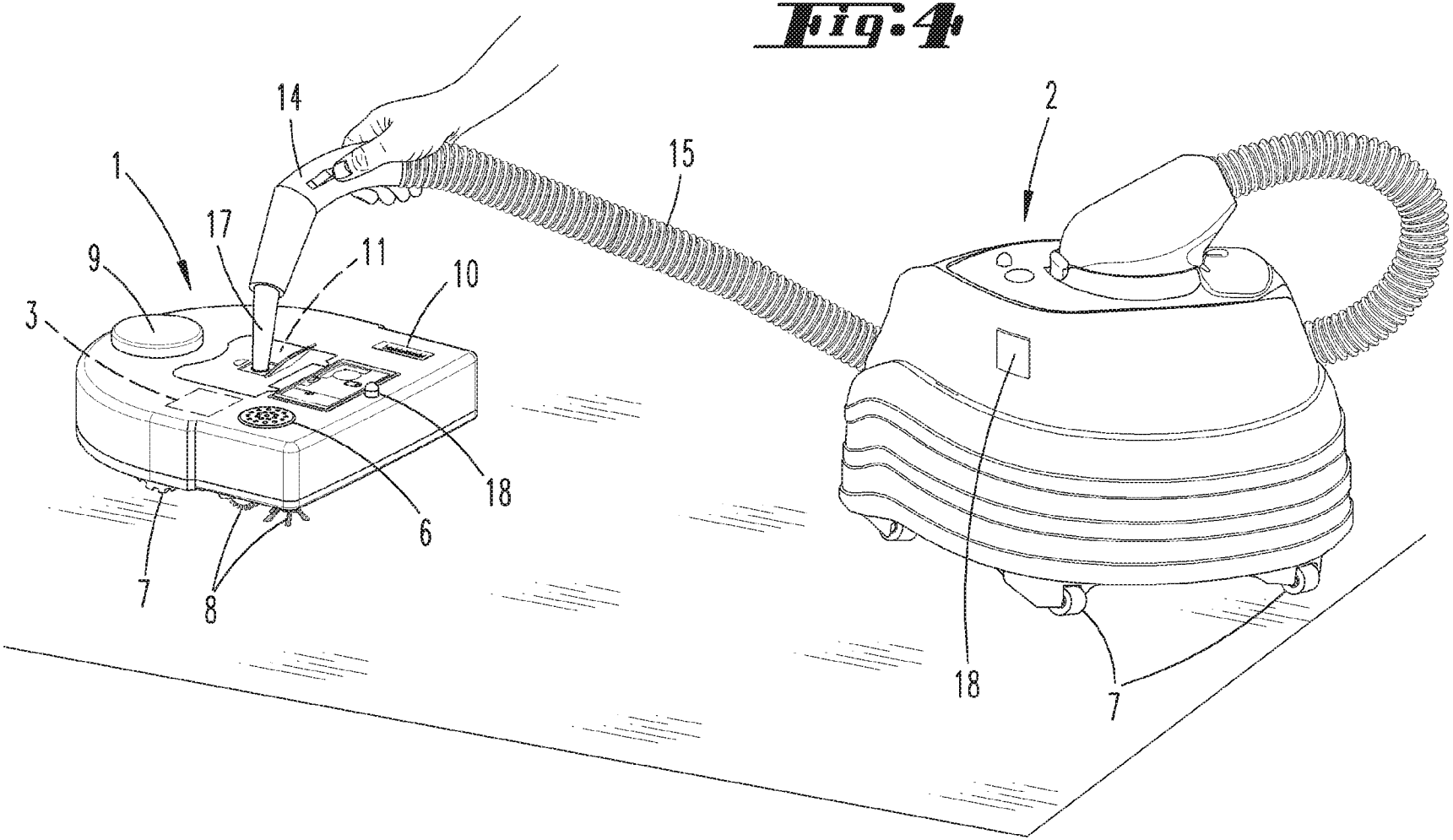

Finally, FIG. 4 shows how the second cleaning device 2 performs the service. The user 5 has removed the stalk 13 and floor nozzle 12 from the second cleaning device 2, so that the suction nozzle 17 with a smaller opening diameter forms a free end area of the hose 15. The suction nozzle 17 is introduced into the suction material collector 11, so that a motor-fan mechanism of the second cleaning device 2 can transfer the dust and dirt present in the suction material collector 11 of the first cleaning device 1 into a separate suction material collector (not depicted) of the second cleaning device 2. During the service, the controller 3 checks the fill level of the suction material collector 11, and preferably sends an acoustic message to the user 5 as soon as the suction material collector 11 has been completely emptied.

Even though the embodiment according to FIGS. 2 to 4 was here explained proceeding from a situation in which the second cleaning device 2 is still turned off and not yet in operation, it is of course also possible that the cleaning device 2 be turned on and transmit its service availability status to the first cleaning device 1 or shared controller 3 of the system.

Figure 5:
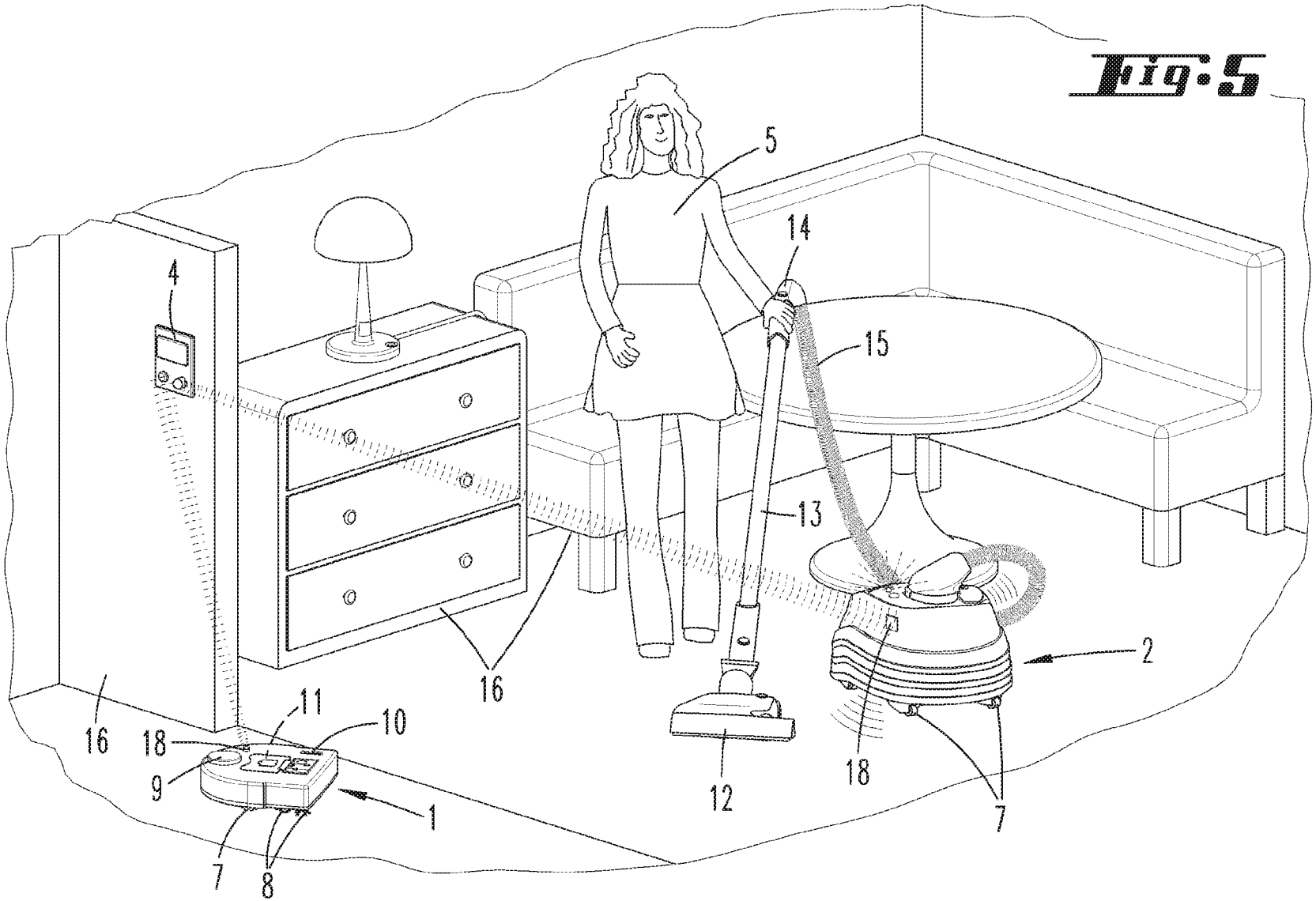
FIG. 5 is a second embodiment of a system with two cleaning devices.

FIG. 5 shows a second embodiment of the invention, which has a system with two cleaning devices 1, 2 and an external, central controller 4 arranged outside of the cleaning devices 1, 2. For example, the controller 4 is here simultaneously a controller 4 of a home automation system, to which other household appliances can also be connected at the same time, for example lights, heaters, shutters, a closing system and the like. For example, the cleaning devices 1, 2 are here designed as explained above in relation to the exemplary embodiment according to FIGS. 2 to 4, but the first cleaning device 1 here has no shared controller 3 of the system. Rather, the entire controller 4 of the system is now the external controller 4 fastened to a wall of the room.

During the operation of the second cleaning device 2, the second cleaning device 2 transmits a status about its service availability to the separate controller 4. In addition, the first cleaning device 1 transmits information about a required service for one of its device components, e.g., here specifically the suction material collector 11, to the shared controller 4. The controller 4 thereupon checks which cleaning device 2 of the system currently reported an active service availability. In the embodiment according to FIG. 5, this is the second cleaning device 2. Depending on the signaled required service of the first cleaning device 1 and the active service availability status of the second cleaning device 2, the shared controller 4 then generates a request that a service be performed, and transmits it to the second cleaning device 2. For example, this request here contains a haptic signal for the user as manifested in a vibration of the second cleaning device 2. In addition, the controller 4 sends a control command to move the first cleaning device 1 to the first cleaning device 1, wherein the control command simultaneously also displays the current position of the second cleaning device 2 within the environment. The first cleaning device 1 thereupon moves to the location of the second cleaning device 2, where the user 5 is currently performing a cleaning job with the second cleaning device 2. As soon as the user 5 notices the first cleaning device 1, he or she can perform the service on the first cleaning device 1, specifically vacuum out the suction material collector 11 of the first cleaning device 1 by means of the suction nozzle 17 of the second cleaning device 2.

Even though not depicted in the aforementioned embodiments, It goes without saying that the cleaning devices 1, 2 can also be other cleaning devices, e.g., a stationary base station for one of the cleaning devices 1, 2, a combined vacuum-wiping cleaning device, two cleaning robots, two cleaning devices that can be hand guided exclusively by a user 5, and the like. Depending on the mobility of the cleaning devices 1, 2 present in the system, the method is implemented analogously to either the first or second embodiment depicted. Of course, the aforementioned embodiments can also be combined.

REFERENCE LIST

1 Cleaning device
2 Cleaning device
3 Controller
4 Controller
5 User
6 Display means
7 Wheel
8 Cleaning element
9 Detection system
10 Fill level display
11 Suction material collector
12 Floor nozzle
13 Stalk
14 Handle
15 Hose
16 Obstacle
17 Suction nozzle
18 Communications module

What is claimed is:

1. A system comprising:

at least two cleaning devices, wherein at least one of the cleaning devices can be displaced relative to another cleaning device, and a shared controller to which the cleaning devices each have a communications link, wherein the controller is a central controller of the system formed outside of the cleaning devices, to which the cleaning devices are registered and which is available even when the cleaning devices are turned off, wherein the controller is configured to transmit a service request to a second one of the cleaning devices and/or to a user of the second cleaning device, depending on a service required by a device component of a first one of the cleaning devices, and depending on a service availability status of the second cleaning device.

2. The system according to claim 1, wherein the controller is configured to transmit a control command for performing the service to the second cleaning device.

3. The system according to claim 1, wherein the controller is a controller of a home automation system.

4. The system according to claim 1, wherein the first cleaning device is a vacuum cleaner and the device component requiring service is a suction material collector of the vacuum cleaner, and/or wherein the second cleaning device is a vacuum cleaner manually guideable by a user.

5. The system according to claim 1, wherein the controller is configured to generate a control command for moving the second cleaning device to a device location of the first cleaning device and transmit the device location to the second cleaning device, and/or to generate a control command for moving the first cleaning device to a device location of the second cleaning device and transmit the device location to the first cleaning device.

6. A method for operating a system with at least two cleaning devices that are displaceable relative to each other, comprising the following steps:

registering the cleaning devices to a shared central controller of the system formed outside of the cleaning devices, communicating with the cleaning devices with a shared controller via a communications link, transmitting with the controller a request for performing a service to a second one of the cleaning devices and/or to a user of the second cleaning device, depending on a required surface for a device component of a first one of the cleaning devices and depending on a service availability status of the second cleaning device, wherein the controller is available for communication even when the cleaning devices are turned off.

7. The method according to claim 6, wherein the request for performing a service is transmitted acoustically, optically and/or haptically to the user by a display of the first or second cleaning device.

8. The method according to claim 6, wherein the controller controls the second cleaning device for performing a service on the device component of the first cleaning device.

9. The method according to claim 6, further comprising the steps of:

generating with the controller a control command for moving the second cleaning device to a device location of the first cleaning device and/or moving the first cleaning device to a device location of the second cleaning device, and transmitting the control command to the second cleaning device and/or to the first cleaning device.

10. The method according to claim 6, further comprising the steps of:

detecting a fill level of a suction material collector of the first cleaning device, wherein a required service for the suction material collector is transmitted to the controller, determining a service availability status for the second cleaning device, controlling at least one of the cleaning devices in such a way that the at least one cleaning device moves toward the other one of the cleaning devices, and emptying the suction material collector of the first cleaning device by a mechanism of the second cleaning device.

* * * * *